US010352169B2

(12) United States Patent
Ito et al.

(10) Patent No.: US 10,352,169 B2
(45) Date of Patent: Jul. 16, 2019

(54) ROTARY ACTUATOR

(71) Applicant: NABTESCO CORPORATION, Tokyo (JP)

(72) Inventors: Koji Ito, Gifu-ken (JP); Atsushi Fukui, Gifu-ken (JP)

(73) Assignee: NABTESCO CORPORATION, Tokyo (JP)

( * ) Notice: Subject to any disclaimer, the term of this patent is extended or adjusted under 35 U.S.C. 154(b) by 106 days.

(21) Appl. No.: 14/974,192

(22) Filed: Dec. 18, 2015

(65) Prior Publication Data

US 2016/0177722 A1 Jun. 23, 2016

(30) Foreign Application Priority Data

Dec. 22, 2014 (JP) ..... 2014-258964

(51) Int. Cl.

| | |
|---|---|
| ***F01C 21/08*** | (2006.01) |
| ***F01C 9/00*** | (2006.01) |
| ***F01C 21/02*** | (2006.01) |
| ***F04C 15/00*** | (2006.01) |
| ***F15B 15/12*** | (2006.01) |

(52) U.S. Cl.

CPC ..... *F01C 9/002* (2013.01); *F01C 21/02* (2013.01); *F01C 21/08* (2013.01); *F04C 15/0076* (2013.01); *F15B 15/125* (2013.01)

(58) Field of Classification Search

CPC ..... F01C 9/002; F01C 11/002; F01C 1/063; F04C 9/002; F15B 15/125; F15B 15/12

USPC ..... 92/120, 178, 181 R, 182

See application file for complete search history.

(56) References Cited

U.S. PATENT DOCUMENTS 1,761,123 A * 6/1930 Gruver ..... F02F 1/183 277/434
2,074,202 A * 3/1937 Benedek ..... F16C 19/30 384/548
2,712,483 A * 7/1955 Ciaccia ..... F16J 1/02 384/49
3,398,653 A * 8/1968 Foster ..... F02F 3/00 92/178

(Continued)

FOREIGN PATENT DOCUMENTS

DE 871557 C 3/1953
EP 2 586 966 A2 5/2013

(Continued)

OTHER PUBLICATIONS

Extended European Search Report as issued in European Patent Application No. 15200387.7, dated May 18, 2016.

(Continued)

*Primary Examiner* — Nathaniel E Wiehe
*Assistant Examiner* — Dustin T Nguyen
(74) *Attorney, Agent, or Firm* — Pillsbury Winthrop Shaw Pittman, LLP

(57) ABSTRACT

A rotary actuator includes an output shaft, a housing, a piston, and a friction reducer. The housing includes an arcuate bore that extends around the output shaft. The piston is coupled to the output shaft and moved in the arcuate bore. Pressure fluid acts to move the piston. The friction reducer is configured to reduce friction between a peripheral surface of the piston and an inner circumferential surface of the housing forming the arcuate bore.

4 Claims, 12 Drawing Sheets

(56) References Cited

U.S. PATENT DOCUMENTS

| | | | | |
|---|---|---|---|---|
| 3,444,788 | A * | 5/1969 | Sneen | F01C 1/063 92/120 |
| 4,644,851 | A * | 2/1987 | Young | F04B 39/0005 417/437 |
| 4,932,313 | A * | 6/1990 | Gutknecht | F15B 15/1447 384/115 |
| 7,387,062 | B2 * | 6/2008 | Chen | F15B 15/1447 92/172 |
| 2013/0133513 | A1 * | 5/2013 | Ito | F04C 9/00 92/120 |
| 2014/0238228 | A1 | 8/2014 | Sobolewski et al. | |

FOREIGN PATENT DOCUMENTS

| | | | |
|---|---|---|---|
| GB | 749695 | A | 5/1956 |
| GB | 1122723 | A | 8/1968 |
| JP | 44-12168 | | 6/1969 |
| JP | 5-17206 | U | 3/1993 |
| JP | 2000-230513 | A | 8/2000 |
| JP | 2006-283789 | A | 10/2006 |
| JP | 2009-097613 | A | 5/2009 |
| JP | 2010-169176 | A | 8/2010 |
| JP | 2013-113347 | A | 6/2013 |

OTHER PUBLICATIONS

Notification of Reasons for Refusal Japanese Patent Application No. 2014-258964 dated Sep. 25, 2018 with English translation.

* cited by examiner

ROTARY ACTUATOR

CROSS-REFERENCE TO RELATED APPLICATIONS

This application is based upon and claims the benefit of priority from prior Japanese Patent Application No. 2014-258964, filed on Dec. 22, 2014, the entire contents of which are incorporated herein by reference.

FIELD

The present invention relates to a rotary actuator that changes, for example, a control surface of an aircraft wing.

BACKGROUND

Japanese Laid-Open Patent Publication No. 2013-113347 describes a rotary actuator that includes an output shaft, an arcuate piston, and a cylinder, which accommodates the output shaft and the piston. A seal is attached to the piston, An arcuate first pressure chamber and an arcuate second pressure chamber are defined in the cylinder. In the rotary actuator, pressure fluid is supplied to one of the first pressure chamber and the second pressure chamber and discharged from the other one of the first pressure chamber and the second pressure chamber to push the piston and rotate the output shaft. The arcuate-piston-type rotary actuator reduces the leakage of the pressure fluid as compared to a vane-type rotary actuator.

SUMMARY

In the rotary actuator described in Japanese Laid-Open Patent Publication No. 2013-113347, an arm connects the piston to the output shaft. When the pressure fluid pushes the piston, the piston is pressed against the inner circumferential surface of the cylinder about a portion where the piston and the arm are connected. This increases the friction between the piston and the cylinder and decreases the ratio of the drive torque of the output shaft relative to the force of the pressure fluid pushing the pistons. That is, the output efficiency of the rotary actuator is lowered.

It is an object of the present invention to provide a rotary actuator in which a piston is smoothly movable relative to a cylinder.

One aspect of the present invention is a rotary actuator that includes an output shaft, a housing, at least one piston, and a friction reducer. The housing includes at least one arcuate bore that extends around the output shaft. The at least one piston is coupled to the output shaft and moved in the arcuate bore. Pressure fluid acts to move the piston. The friction reducer is configured to reduce friction between a peripheral surface of the piston and an inner circumferential surface of the housing forming the arcuate bore.

In the rotary actuator, the friction reducer reduces the friction between the peripheral surface of the piston and the inner circumferential surface of the housing. Thus, even when the pressure fluid of the pressure chamber presses the peripheral surface of the piston against the inner circumferential surface of the housing, the piston is smoothly movable relative to the housing. This improves the output efficiency of the rotary actuator.

In some implementations, the friction reducer includes a roller that is in contact with the peripheral surface of the piston, and the roller rolls when the piston moves.

In the rotary actuator, the roller supports the peripheral surface of the piston. Thus, the sliding friction between a portion of the peripheral surface of the piston and the inner circumferential surface of the housing is converted into rolling friction of the roller. This reduces the friction between the peripheral surface of the piston and the inner circumferential surface of the housing and allows the piston to smoothly move relative to the housing.

In some implementations, the roller is supported by a bearing.

In the rotary actuator, the bearing further easily rolls the roller. This reduces the rolling friction of the piston and the roller.

In some implementations, the peripheral surface of the piston includes an arcuate outer surface, and the roller is in linear contact with the arcuate outer surface.

In the rotary actuator, the roller is resistant to deformation compared to a structure in which the peripheral surface of the piston is in point contact with the roller. This allows the roller to easily roll relative to the piston.

In some implementations, the friction reducer includes a stopper that reduces force pressing the piston against the inner circumferential surface of the housing.

In the rotary actuator, the force pressing the piston against the inner circumferential surface of the housing is decreased compared to a structure that does not include a stopper. This limits increases in the friction between the peripheral surface of the piston and the inner circumferential surface of the housing.

In some implementations, the output shaft includes an arm coupled to the piston, the piston and the arm are coupled in an axial direction of the output shaft by a first coupling portion and a second coupling portion, the first coupling portion and the second coupling portion are separated from each other, and at least one of the first coupling portion and the second coupling portion configures the stopper.

In the rotary actuator, the coupling portion of the arm and the piston configure a stopper. This simplifies the structure of the rotary actuator compared to, for example, when the stopper is a coupling rod, which couples the output shaft and the piston.

In some implementations, the rotary actuator further includes an outer fluid bearing chamber defined between the peripheral surface of the piston and the inner circumferential surface of the housing. The outer fluid bearing chamber is in communication with a pressure chamber defined by the piston and the arcuate bore. The stopper includes the outer fluid bearing chamber and a fluid passage, which communicates the pressure chamber and the outer fluid bearing chamber.

In the rotary actuator, the hydraulic pressure of the outer fluid bearing chamber is applied through the fluid passage and inwardly pushes the peripheral surface of the piston. This decreases the force pressing the peripheral surface of the piston against the inner circumferential surface of the housing. Additionally, the movement of the piston moves the outer fluid bearing chamber moves. Thus, the outer fluid bearing chamber may be formed in a desired position regardless of a movement range of the piston. This increases the degree of freedom for a location where the outer fluid bearing chamber is formed.

In some implementations, the at least one piston includes a first piston and a second piston. The first piston and the second piston are located at opposite sides of the output shaft. The stopper includes a coupling rod that couples the first piston and the second piston in a radial direction.

In the rotary actuator, the coupling rod functions as a stopper shared by the first piston and the second piston. Thus, when the rotary actuator includes a plurality of pistons, the number of components of the rotary actuator is reduced compared to a structure in which a stopper is arranged for each stopper.

In some implementations, the at least one piston includes a first piston and a second piston. The first piston and the second piston are located at opposite sides of the output shaft. The stopper includes a ring that couples the first piston and the second piston.

In the rotary actuator, the ring functions as a stopper shared by the first piston and the second piston. Thus, when the rotary actuator includes a plurality of pistons, the number of components of the rotary actuator is reduced compared to a structure in which a stopper is arranged for each stopper.

In some implementations, the piston includes a head and a non-head portion, and the friction reducer is configured to mechanically interact with a radially outer surface of the non-head portion of the piston at a location other than the arcuate bore.

In some implementations, the roller is arranged adjacent to or separated from the arcuate bore in a circumferential direction.

Another aspect of the present invention is a rotary actuator that includes an output shaft, a housing, a piston, and a rolling bearing. The housing includes an arcuate bore that extends around the output shaft. The piston is coupled to the output shaft and moved in the arcuate bore. Pressure fluid acts to move the piston. The rolling bearing includes a rotational race and a bearing roller. The rotational race forms the arcuate bore. The rotational race is in contact with the peripheral surface of the piston. The bearing roller is located between the inner circumferential surface of the housing and the rotational race.

In the rotary actuator, when the piston moves, the rotational race of the rolling bearing rotates in the movement direction of the piston. Thus, even when the peripheral surface of the piston is pressed against the rotational race, the piston is smoothly movable.

In some implementations, the piston includes an outer side surface, and at least a portion of the outer side surface of the piston and the inner circumferential surface of the housing are spaced apart by a gap.

The inventors of the present application have found that the friction is reduced between the peripheral surface of the piston and the inner circumferential surface of the housing when decreasing the size of an area of the peripheral surface of the piston that contacts the inner circumferential surface of the housing. Hence, the rotary actuator includes a gap between the outer side surface of the piston and the inner circumferential surface of the housing. This reduces the friction and allows the piston to smoothly move relative to the housing.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE EMBODIMENTS

First Embodiment

The structure of a first embodiment of a rotary actuator 1 will now be described with reference to FIGS. 1 to 5.

Figure 1:
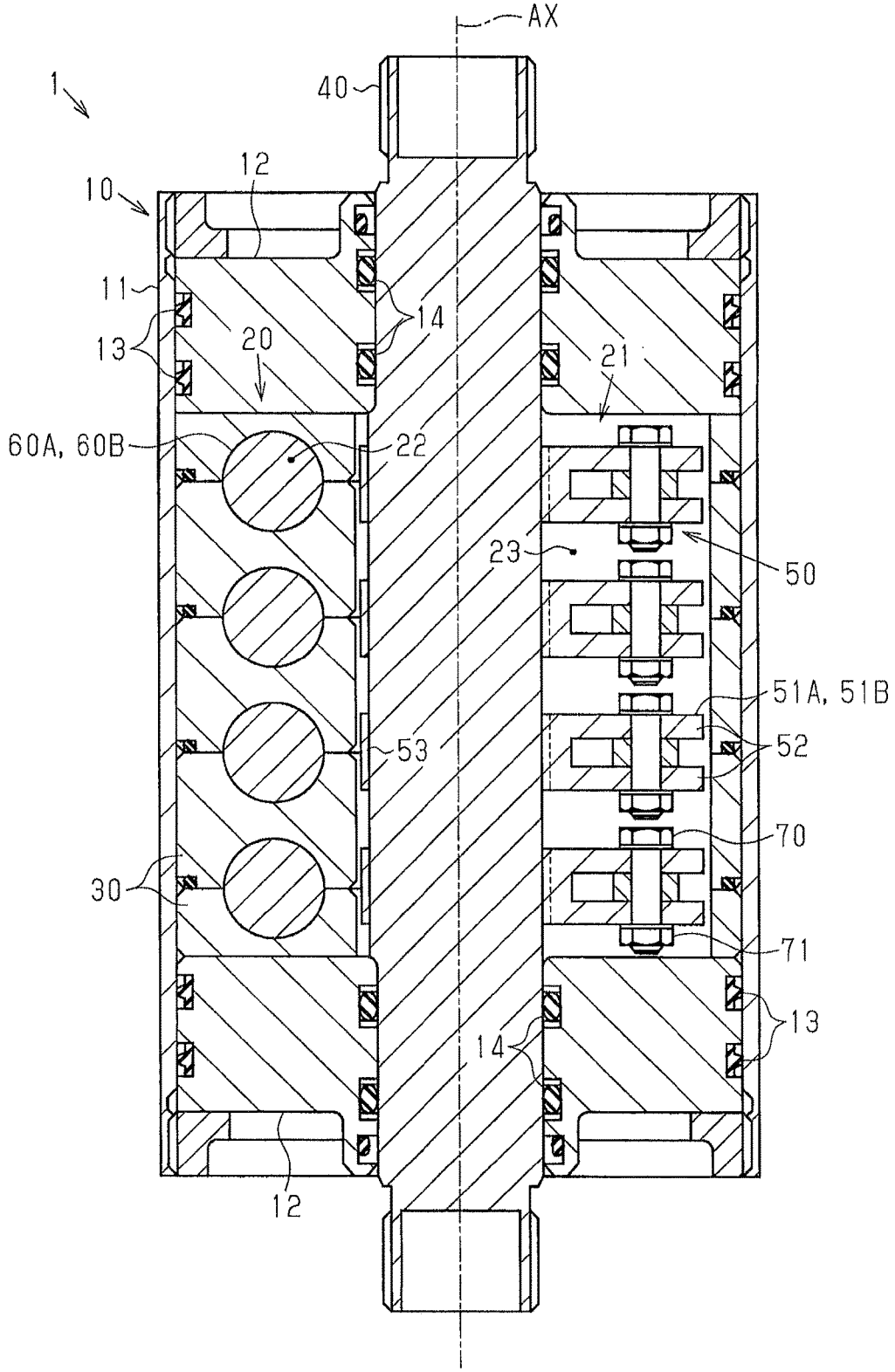
FIG. 1 is a cross-sectional view showing a first embodiment of a rotary actuator.

Referring to FIG. 1, the rotary actuator 1 uses hydraulic oil, which is one example of a pressure fluid, to rotate an output shaft 40 and output drive torque. Here, instead of hydraulic oil, compressed air or the like may be used as the pressure fluid. Alternatively, powder formed by particles of a metal material, a ceramic material, or a compound of metal and ceramic materials may be used.

The rotary actuator 1 includes a case 10, which includes a tubular case body 11 having two opposite open ends. A tubular or annular block 12 is fixed to each of the two opposite ends of the case body 11 to close the opening of the case body 11. The case 10 includes an inner cavity, which is surrounded by the case body 11 and the two blocks 12. The inner cavity accommodates a cylinder 20, which is one example of a housing, and the output shaft 40. The dashed line of FIG. 1 indicates an axis Ax of the output shaft 40, or the rotary actuator 1. The output shaft 40 includes two opposite ends, each of which projects from the corresponding block 12 and out of the case 10 in the axial direction. Two outer seals 13 are attached to the outer circumference of each block 12 to seal the gap between the case body 11 and the block 12. Two inner seals 14 are attached to the inner circumference of each block 12 to seal the gap between the output shaft 40 and the block 12. This seals the case 10.

Hereafter, the term "axial direction" refers to the direction extending along the axis Ax unless otherwise noted.

Figure 2:
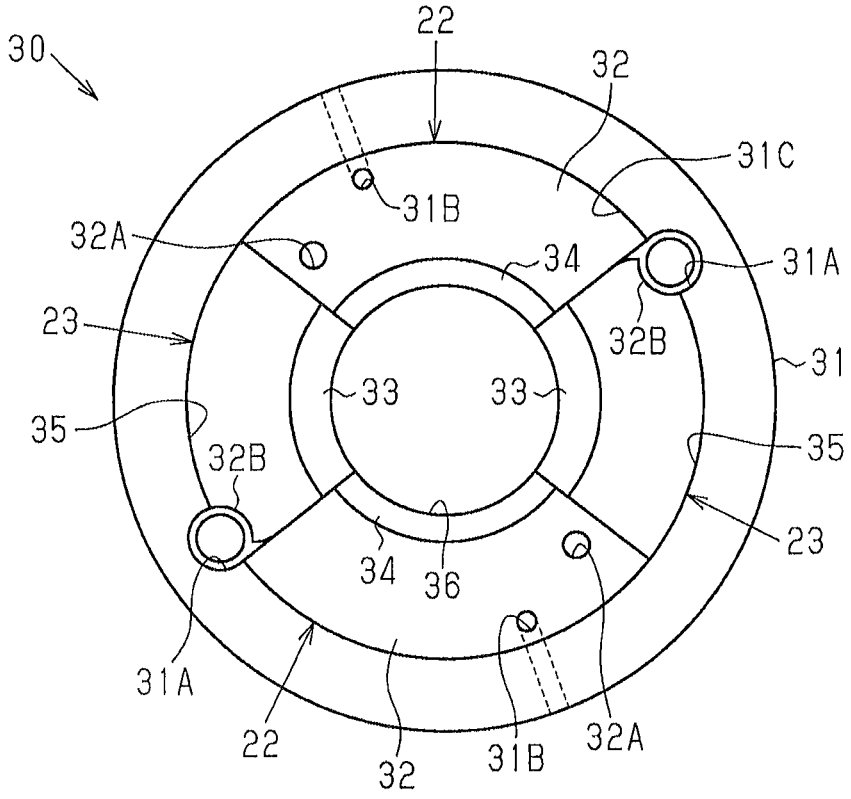
FIG. 2 is a plan view showing a cylinder block.
Figure 3:
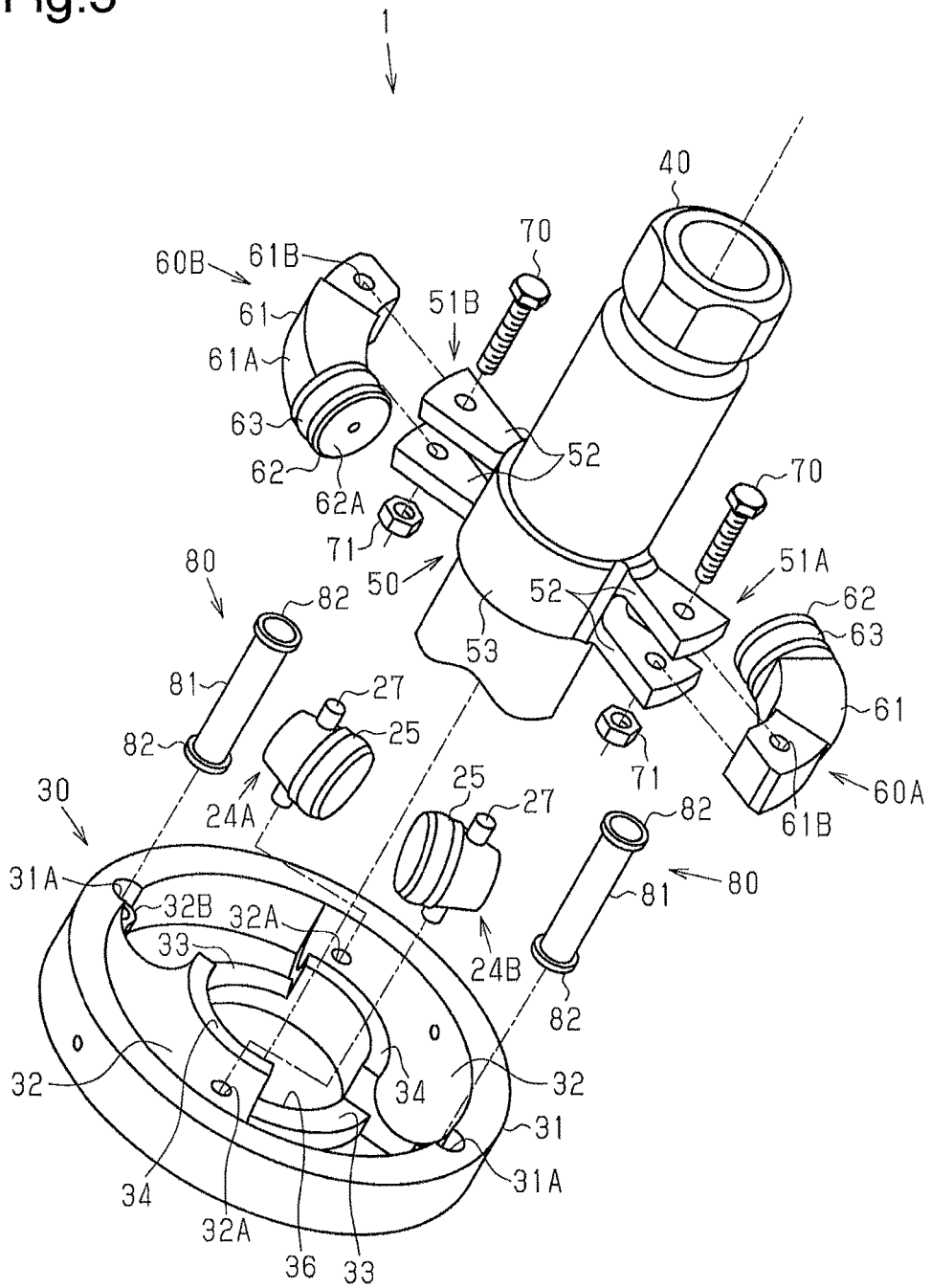
FIG. 3 is an exploded perspective view showing a portion of the rotary actuator.

The cylinder 20 includes five cylinder blocks 30, which are stacked in the axial direction. As shown in FIGS. 2 and 3, each cylinder block 30 may be tubular or annular. As shown in FIG. 1, the cylinder 20 is held between the two blocks 12 in the axial direction. The cylinder 20 includes an inner cavity 21, which is supplied with the hydraulic oil. The inner cavity 21 accommodates, for example, four sets of pistons 60A, 60B, which rotate the output shaft 40, and four arm units 50, which couple the output shaft 40 and the pistons 60A, 60B. The pistons 60A, 60B may be referred to as the first piston and the second piston, respectively.

The inner cavity 21 of the cylinder 20 includes a plurality of arcuate bores 22 and open regions 23. Each arcuate bore 22 is formed between axially adjacent ones of the cylinder blocks 30. The open regions 23 in the five cylinder blocks 30, which are stacked in the axial direction, form voids extending through the cylinder 20.

Here, the number of the arm units 50 and the number of the pistons are not limited. For example, one piston may be used. Alternatively, three or more pistons may be included in each piston set. The number of the cylinder blocks 30 may be changed in accordance with the number of the arm units 50 and the pistons.

As shown in FIG. 2, each cylinder block 30 includes an annular outer wall 31. The outer wall 31 includes two arcuate bottom walls 32, which extend from opposite sides of the output shaft 40 inward in the radial direction. Each bottom wall 32 includes an arcuate, semi-cylindrical bore surface. Further, each bottom wall 32 includes an inner circumferential portion defining an arcuate inner wall 34, which is opposed to the outer wall 31 in the radial direction. In the circumferential direction of the rotary actuator 1, one end of each bottom wall 32 includes a bearing support 32B having a closed end, and the other end of each bottom wall 32 includes a positioning hole 32A. The bearing support 32B is located at the bottom side of each cylinder block 30 in the axial direction. A portion of the outer wall 31 corresponding to one circumferential end of each bottom wall 32 includes a recess 31A. Connection walls 33 are connected to the circumferential ends of each bottom wall 32 to connect the bottom walls 32 to each other. The connection walls 33 have a smaller radial dimension than the bottom walls 32. Openings 35 extend through each cylinder block 30 in the axial direction between the connection walls 33 and the outer wall 31 in the radial direction. An insertion hole 36 extends through each cylinder block 30 in the axial direction at an inner side of the connection walls 33. Each cylinder block 30 configures a single member in which the outer wall 31, the bottom walls 32, the connection walls 33, and the inner walls 34 are continuous with one another.

Each arcuate bore 22 is encompassed by the corresponding inner wall 34, the portion of the outer wall 31 opposed to the inner wall 34, and the corresponding bottom wall 32. The arcuate bore 22 is an elongated hole that is arcuate about the output shaft 40. More specifically, the arcuate bores 22 are located in two radially opposed portions of the cylinder 20 (refer to FIG. 1). The open regions 23 include the circumferential gaps between the two inner walls 34 and the two openings 35. Alternatively, when the bottom walls 32 are formed to cover one axial end of each opening 35, the open regions 23 may be formed between axially adjacent cylinder blocks 30 in the same manner as the arcuate bores 22.

As shown in FIG. 3, the output shaft 40 is inserted through the insertion hole 36 of each cylinder block 30. The arm units 50 are fixed to the output shaft 40 and cannot be rotated relative to the output shaft 40. Each arm unit 50 includes two sets of arm pairs 51A, 51B, each of which is one example of an arm, and a ring-shaped joint 53, which is joined to each set of arm pairs 51A, 51B and fixed to the output shaft 40. The two sets of arm pairs 51A, 51B are opposed to each other in the radial direction. Each set of arm pairs 51A, 51B includes two sectoral arms 52, which are separated from each other in the axial direction and extend in the radial direction. Here, when the joint 53 is omitted, each set of arm pairs 51A, 51B may be configured to be directly fixed to the output shaft 40. Alternatively, the output shaft 40 and each set of arm pairs 51A, 51B may be formed as a single member.

The piston 60A is coupled to a distal portion of the corresponding arm pair 51A. The piston 60B is coupled to a distal portion of the corresponding arm pair 51B. The piston 60A includes an arcuate piston body 61 and an arcuate piston head 62 (also referred to as seal portion), which is located on the distal end of the piston body 61. The arcuate piston body 61 may be referred to as a non-head portion of the piston.

The seal portion 62 of the piston 60A has a circular end surface 62A. An annular packing 63 is coupled to the seal portion 62. One example of the packing 63 is an O-ring.

A coupling hole 61B extends through a basal portion of the piston body 61 in the axial direction and receives a bolt 70. When the basal portion of the piston body 61 is located between the two arms 52 of the arm pair 51A, the piston body 61 is pivotally coupled to the arm pair 51A by the bolt 70 and a nut 71. Instead of having the arcuate shape, the piston body 61 may, for example, be shaped straight and extend toward the arms 52.

Figure 4:
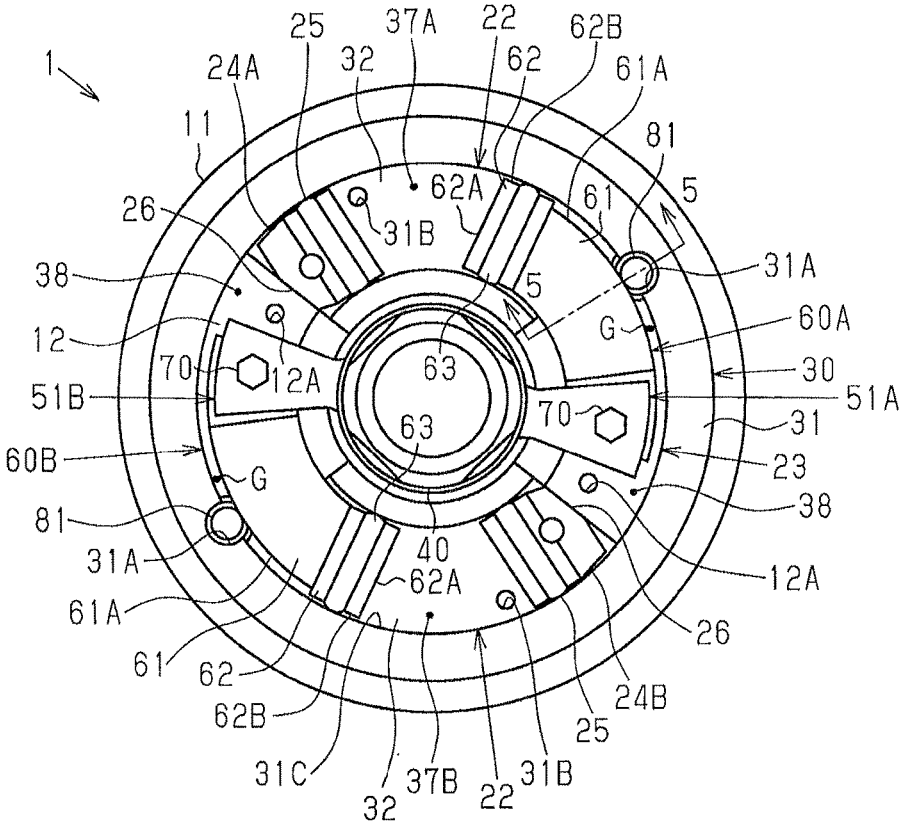
FIG. 4 is a plan view showing the internal structure of the rotary actuator.

The peripheral surface of the arcuate piston body 61 of the piston 60A includes an arcuate outer side surface 61A, which is parallel to the axis Ax. As shown in FIG. 4, a gap G is formed between the arcuate outer side surface 61A of the piston body 61 and the outer wall 31 of the cylinder block 30. The gap G is in communication with the open region 23 and filled with the hydraulic oil. The piston 60B has the same shape as the piston 60A. The coupling structure of the piston 60B and the arm pair 51B is the same as that of the piston 60A and the arm pair 51A.

As shown in FIG. 3, the rotary actuator 1 includes friction reducers 80. Each friction reducer 80 includes a rod-shaped roller 81, which supports the corresponding one of the pistons 60A, 60B from a radially outer side, and two rolling bearings 82, each of which is one example of a bearing that rotationally supports the roller 81 relative to the cylinder block 30. The bearing is not limited to a rolling bearing 82 and may be a plain bearing, a magnetic bearing, an air bearing, or the like.

The two rolling bearings 82 are coupled to two axial ends of the roller 81. The rolling bearings 82 are coupled to the bearing supports 32B of the cylinder block 30. Thus, the rolling bearings 82 are located at axially opposite sides of the piston body 61.

Figure 5:
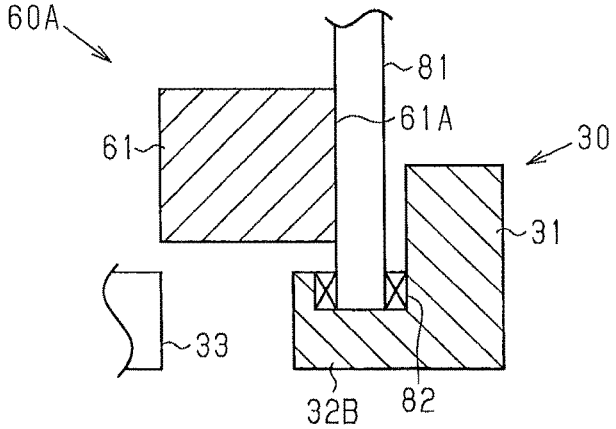
FIG. 5 is a cross-sectional view taken along line 5-5 in FIG. 4.

As shown in FIG. 4, the rollers 81 are each inserted into the recess 31A of the corresponding outer wall 31 and located at one circumferential end of corresponding bottom wall 32. The rollers 81 inwardly project beyond an inner circumferential surface 31C of the outer wall 31. As shown in FIG. 5, the roller 81 has a larger axial dimension than the piston body 61. The roller 81 is in linear contact with the arcuate outer side surface 61A of the piston body 61. The relationship of the roller 81 and the piston 60B is the same as that of the roller 81 and the piston 60A. Here, a plurality of rollers 81 may support the piston 60A, and a further plurality of rollers 81 may support the piston 60B.

As shown in FIG. 3, rod-shaped partition pistons 24A, 24B are respectively coupled to the positioning holes 32A in the bottom walls 32 of the cylinder block 30. The partition pistons 24A, 24B each include a distal portion, to which an annular packing 25 is attached. One example of the packing 25 is an O-ring. The partition pistons 24A, 24B each include a central portion, to which an axially extended pin 27 is coupled. Each pin 27 projects from the corresponding one of the partition pistons 24A, 24B in the axial direction. The pins 27 are, for example, press-fitted to the positioning holes 32A. As shown in FIG. 4, the partition pistons 24A, 24B each include a basal portion, which includes a cutaway portion 26 that is parallel to the adjacent circumferential end surface of the corresponding bottom wall 32. Here, instead of the partition pistons 24A, 24B, the cylinder block 30 may include partition walls that correspond to the partition pistons 24A, 24B.

As shown in FIG. 4, a first hydraulic chamber 37A (also referred to as a pressure chamber) extends in the circumferential direction between the partition piston 24A and the seal portion 62 of the piston 60A in the corresponding arcuate bore 22. A further first hydraulic chamber 37B (also referred to as a pressure chamber) extends in the circumferential direction between the partition piston 24B and the seal portion 62 of the piston 60B in the corresponding arcuate bore 22. Additionally, a second hydraulic chamber 38 extends from one of the open regions 23 to the seal portion 62 of the piston 60A in the corresponding arcuate bore 22. A further second hydraulic chamber 38 extends from the other open region 23 to the seal portion 62 of the piston 60B in the corresponding arcuate bore 22. The hydraulic oil is supplied to and discharged from the first hydraulic chambers 37A, 37B through supply-discharge holes 31B, which are formed in portions of the outer wall 31 of the cylinder block 30 that are opposed to the first hydraulic chambers 37A, 37B. The hydraulic oil is supplied to and discharged from the second hydraulic chambers 38 through supply-discharge holes 12A, which are formed in portions of the blocks 12 that are opposed to the second hydraulic chambers 38.

Figure 6:
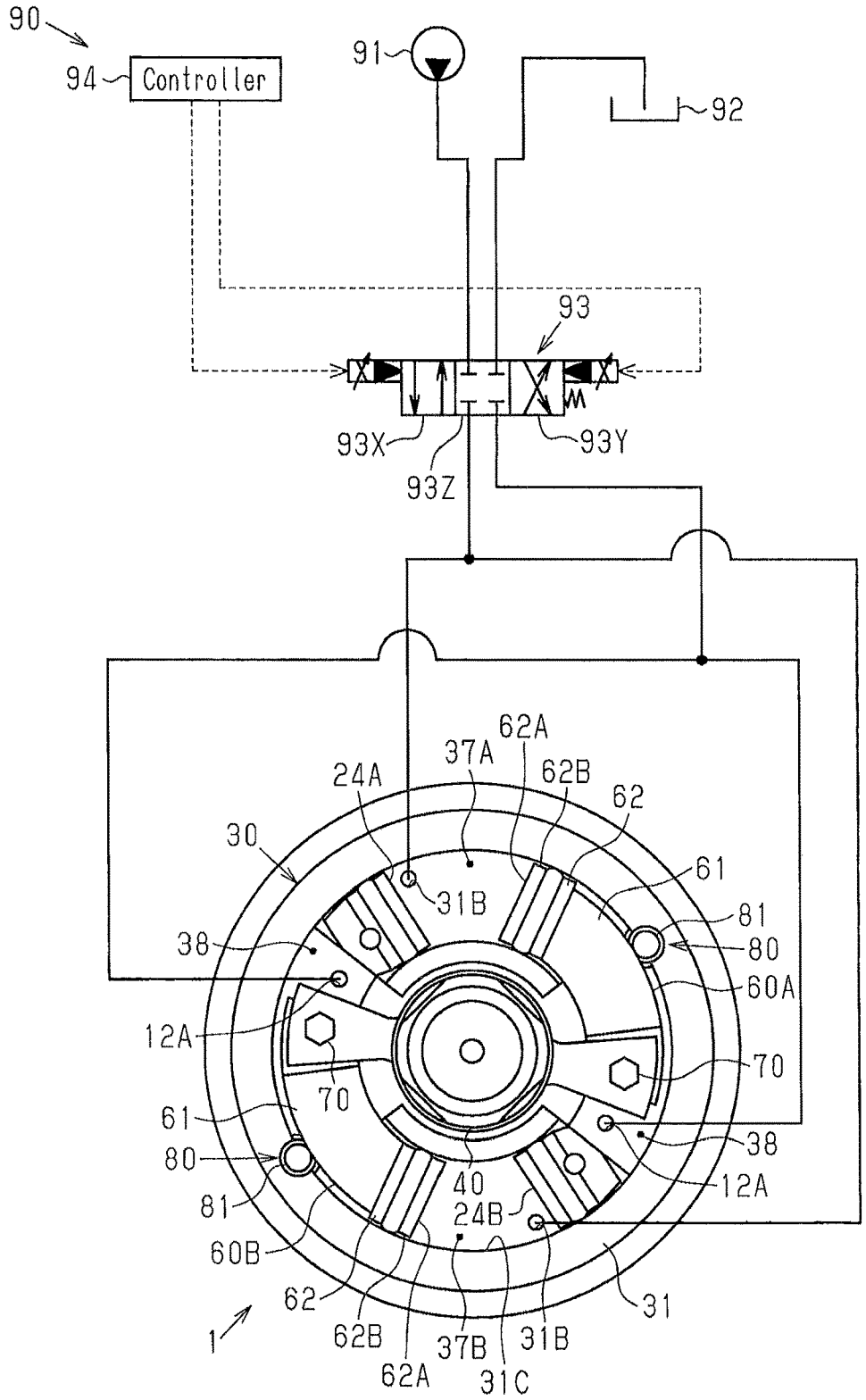
FIG. 6 is a diagram showing the structure of a driver including the rotary actuator.

The structure of a driver 90 including the rotary actuator 1 will now be described with reference to FIG. 6.

The driver 90 includes a hydraulic pressure source 91, which supplies the hydraulic oil to the rotary actuator 1, and a reservoir 92, to which the hydraulic oil is discharged from the rotary actuator 1. A control valve 93, which switches the supply-discharge mode of the hydraulic oil of the rotary actuator 1, is located between the hydraulic pressure source 91 and the reservoir 92. The operations of the control valve 93 and the hydraulic pressure source 91 are controlled, for example, by a controller 94 including a microcomputer. The hydraulic pressure source 91, the reservoir 92, the control valve 93, and the rotary actuator 1 are connected by oil passages.

The control valve 93 is, for example, a solenoid valve and connected to the hydraulic pressure source 91, the reservoir 92, and the rotary actuator 1. The control valve 93 may be shifted to a first communication position 93X, a second communication position 93Y, and an interruption position 931. In the first communication position 93X, the control valve 93 supplies hydraulic oil from the hydraulic pressure source 91 to the first hydraulic chambers 37A, 37B and discharges hydraulic oil from the second hydraulic chambers 38. In the second communication position 93Y, the control valve 93 supplies hydraulic oil from the hydraulic pressure source 91 to the second hydraulic chambers 38 and discharges hydraulic oil from the first hydraulic chambers 37A, 37B. In the interruption position 93Z, the control valve 94 interrupts the supply of hydraulic oil from the hydraulic pressure source 91 to the rotary actuator 1 and interrupts the discharge of hydraulic oil from the rotary actuator 1 to the reservoir 92.

The operation of the rotary actuator 1, which is driven by the driver 90, will now be described.

When forwardly rotating the output shaft 40, the controller 94 controls and shifts the control valve 93 to the first communication position 93X. Thus, hydraulic oil is supplied from the hydraulic pressure source 91 to the first hydraulic chambers 37A, 37B and discharged from the second hydraulic chambers 38. Consequently, the pistons 60A, 60B orbit in the forward direction (clockwise direction in FIG. 6) and forwardly rotate the output shaft 40.

When reversely rotating the output shaft 40, the controller 94 controls and shifts the control valve 93 to the second communication position 93Y. Thus, hydraulic oil is supplied from the hydraulic pressure source 91 to the second hydraulic chambers 38 and discharged from the first hydraulic chambers 37A, 37B. Consequently, the pistons 60A, 60B orbit in the reverse direction (counterclockwise direction in FIG. 6) and reversely rotate the output shaft 40.

Additionally, when stopping the rotation of the output shaft 40, the controller 94 controls and shifts the control valve 93 to the interruption position 93Z. This interrupts the supply and discharge of the hydraulic oil of the first hydraulic chambers 37A, 37B and the second hydraulic chambers 38. Thus, the pistons 60A, 60B do not orbit. This stops the rotation of the output shaft 40.

The first embodiment has the effects and advantages described below.

(1) When hydraulic oil is supplied to, for example, the first hydraulic chambers 37A, 37B, hydraulic pressure applied to the end surface 62A of the seal portion 62 of each of the pistons 60A, 60B acts to pivot the corresponding seal portion 62 outward in the radial direction about the bolt 70. This presses a circumferential surface 62B of each seal portion 62 against the inner circumferential surface 31C of the outer wall 31 of the cylinder block 30 so that the pistons 60A, 60B orbit in the forward direction.

The piston bodies 61 of the pistons 60A, 60B are supported by the rollers 81, which function as the friction reducers 80. Thus, the forward orbiting of the pistons 60A, 60B rotates the rollers 81. When the pistons 60A, 60B orbit in the forward direction, the seal portions 62 is a sliding friction and the piston bodies 61 are rolling frictions. Thus, the friction between each piston body 61 and the inner circumferential surface 31C of the outer wall 31 is smaller than when the friction between the inner circumferential surface 31C of the outer wall 31 and each of the seal portions 62 and the piston bodies 61 is a sliding friction.

Additionally, the rollers 81 support the piston bodies 61 at an inner side of the inner circumferential surface 31C of the outer wall 31. This decreases the force pressing the circumferential surface 62B of each seal portion 62 against the inner circumferential surface 31C of the outer wall 31. Thus, friction is reduced between the circumferential surface 62B of each seal portion 62 and the inner circumferential surface 31C of the outer wall 31. The reduction in friction between the circumferential surface 62B of the seal portion 62 in each of the pistons 60A, 60B and the inner circumferential surface 31C of the outer wall 31 results in smooth movement of the pistons 60A, 60B. This improves the output efficiency of the rotary actuator 1.

(2) Each friction reducer 80 includes the rolling bearings 82, which support the roller 81 so that the roller 81 is rotatable relative to the cylinder block 30. This facilitates the rolling of the rollers 81 when the pistons 60A, 60B orbit and reduces the rolling friction between the pistons 60A, 60B and the rollers 81.

(3) Each roller 81 is in linear contact with the arcuate outer side surface 61A of the piston body 61 of the corresponding one of the pistons 60A, 60B. Thus, the roller 81 is more resistant to deformation than a structure in which the roller 81 is in point contact with the peripheral surface of the piston body 61 of the corresponding one of the pistons 60A, 60B. This allows the rollers 81 to easily roll relative to the pistons 60A, 60B.

(4) The inventors of the present application have found that the friction is reduced between the pistons 60A, 60B and the outer wall 31 when the piston bodies 61 of the pistons 60A, 60B do not contact the inner circumferential surface 31C of the outer wall 31 of the cylinder block 30. If the piston bodies 61 are configured to contact the inner circumferential surface 31C of the outer wall 31 when the pistons 60A, 60B orbit and the pistons 60A, 60B receive the hydraulic pressure of the first hydraulic chambers 37A, 37B, the piston bodies 61 deform outward in the radial direction and press the inner circumferential surface 31C of the outer wall 31. This increases the friction between the piston bodies 61 and the inner circumferential surface 31C of the outer wall 31. However, if the piston bodies 61 of the pistons 60A, 60B are not in contact with the inner circumferential surface 31C of the outer wall 31, the piston bodies 61 do not press the inner circumferential surface 31C of the outer wall 31 even when deformed. Thus, it is understood that friction is reduced between the pistons 60A, 60B and the inner circumferential surface 31C of the outer wall 31.

In this regard, in the present embodiment, the gap G is formed between the piston bodies 61 of the pistons 60A, 60B and the inner circumferential surface 31C of the outer wall 31 so that even when deformed outward in the radial direction, the piston bodies 61 do not contact the inner circumferential surface 31C of the outer wall 31. This decreases the area of the pistons 60A, 60B contacting the inner circumferential surface 31C of the outer wall 31 and allows the pistons 60A, 60B to smoothly move.

(5) The bearing supports 32B of each cylinder block 30 are formed in the axial ends of the cylinder block 30. This increases the axial distance between the two rolling bearings 82, which support the roller 81. Thus, the inclination of the roller 81 is decreased when the two bearing supports 32B are misaligned due to machining errors of the cylinder block 30 and assembling errors of the cylinder 20. This limits the force of the rollers 81 that press the pistons 60A, 60B and limits increases in the friction between the rollers 81 and the arcuate outer side surfaces 61A of the pistons 60A, 60B.

The structure of a second embodiment of the rotary actuator 1 will now be described with reference to FIGS. 7 and 8. The same reference characters are given to elements of the rotary actuator 1 of the second embodiment that are the same as the corresponding elements of the rotary actuator 1 of the first embodiment. Such elements will not be described in detail.

Figure 7:
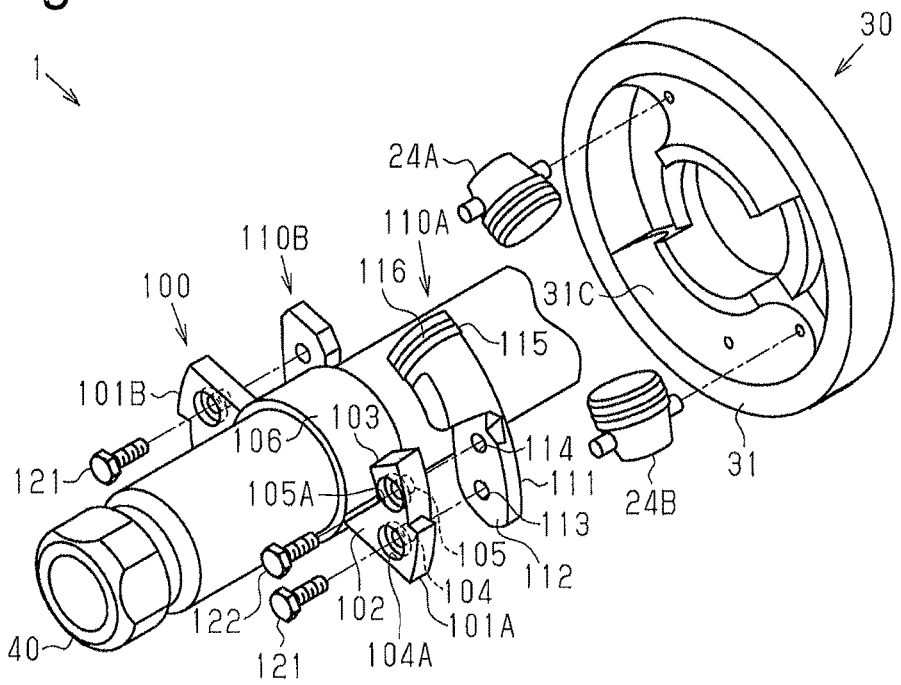
FIG. 7 is an exploded perspective view showing a portion of a second embodiment of a rotary actuator.

As shown in FIG. 7, an arm unit 100 is fixed to the output shaft 40 and cannot be rotated relative to the output shaft 40. The arm unit 100 includes two arms 101A, 101B, which are symmetrical about a point in the output shaft 40, and a joint 106, which is joined to the two arms 101A, 101B and fixed to the output shaft 40. The arm 101A includes a first arm 102, which extends in the radial direction, and a second arm 103, which extends from a radially outer portion of the first arm 102 in the circumferential direction. A first insertion hole 104 and a second insertion hole 105 extend through the second arm 103 in the axial direction at separate positions in the circumferential direction. The insertion holes 104, 105 are provided with counterbores 104A, 105A, respectively. The arm 101B has the same form as the arm 101A.

A piston 110A includes an arcuate piston body 111 and a seal portion 115, which extends from a distal portion of the piston body 111 in the circumferential direction. The seal portion 115 includes a circular end surface. An annular packing 116 is attached to the seal portion 115. One example of the packing 116 is an O-ring. The piston body 111 is overlapped with the second arm 103 in the axial direction. A portion of the piston body 111 that is overlapped with the second arm 103 is cut away in the axial direction to form a cutaway portion 112. A first fastening hole 113 and a second fastening hole 114 are formed in parts of the cutaway portion 112 that are opposed to the first insertion hole 104 and the second insertion hole 105, respectively. A piston 110B has the same form as the piston 110A.

A first bolt 121 is inserted through the first insertion hole 104 and fastened to the first fastening hole 113, and a second bolt 122 is inserted through the second insertion hole 105 and fastened to the second fastening hole 114. This fastens the arm 101A and the piston 110A to each other. The counterbore 104A accommodates a bolt head of the first bolt 121, and the counterbore 105A accommodates a bolt head of the second bolt 122 (refer to FIG. 8). The arm 101B and the piston 110B are fastened in the same manner as the arm 101A and the piston 110A.

The first insertion hole 104, the first fastening hole 113, and the first bolt 121 configure a first coupling portion and a stopper. The second insertion hole 105, the second fastening hole 114, and the second bolt 122 configure a second coupling portion and a stopper.

The arm 101A and the piston 110A may be coupled at three or more locations. Also, the arm 101B and the piston 110B may be coupled at three or more locations. Alternatively, the arm 101A and the piston 110A may be formed by a single member. Also, the arm 101B and the piston 110B may be formed by a single member. When the arm 101A and the piston 110A are formed by a single member and the arm 101E and the piston 110E are formed by a single member, the insertion holes 104, 105, the fastening holes 113, 114, and the bolts 121, 122 are omitted.

The second embodiment has the effects and advantages described below.

Figure 8:
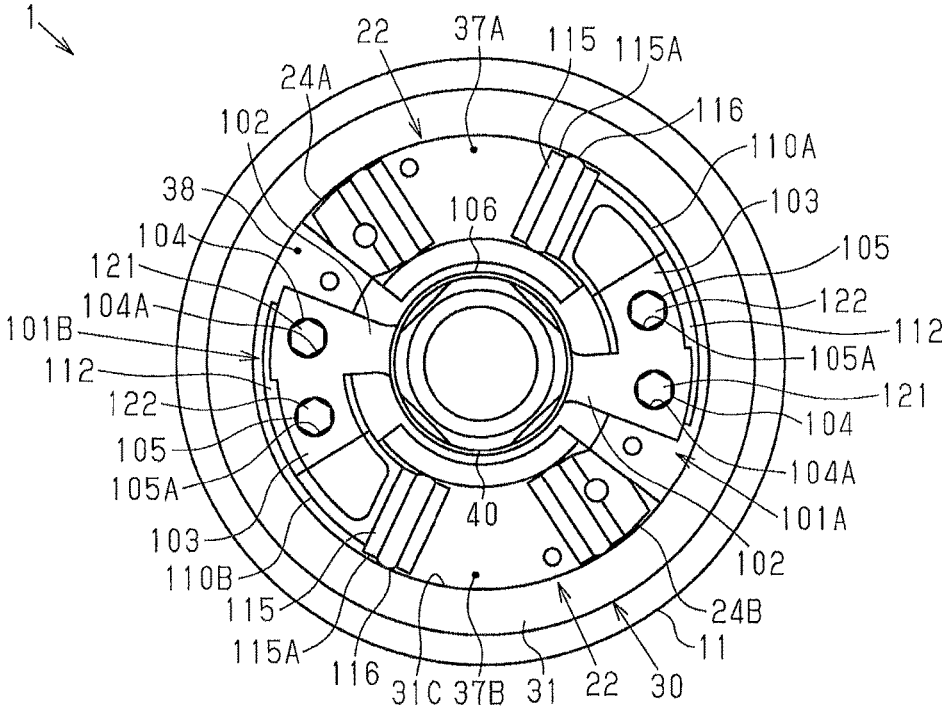
FIG. 8 is a plan view showing the internal structure of the rotary actuator.

As shown in FIG. 8, the arms 101A, 101B and the pistons 110A, 110B are fastened to each other by the first bolt 121 and the second bolt 122, respectively. Thus, even when the hydraulic pressure of the first hydraulic chambers 37A, 37B acts to move the end surfaces of the seal portions 115 of the pistons 110A, 110B outward in the radial direction, the radially outward movement of the seal portions 115 of the pistons 110A, 110B is restricted. This decreases the force that presses the seal portions 115 of the pistons 110A, 110B against the inner circumferential surface 31C of the outer wall 31 and reduces friction between the pistons 110A, 110B and the outer wall 31. Consequently, the smooth movement of the pistons 110A, 110B improves the output efficiency of the rotary actuator 1.

Additionally, the structure of the rotary actuator 1 is simplified compared to a structure additionally including a coupling rod that couples the output shaft 40 and the pistons 110A, 110B and functions as a stopper restricting the radially outward movement of the seal portions 115 of the pistons 110A, 110B.

The structure of a third embodiment of the rotary actuator 1 will now be described with reference to FIGS. 9 and 10. The same reference characters are given to elements of the rotary actuator 1 of the third embodiment that are the same as the corresponding elements of the rotary actuator 1 of the first embodiment. Such elements will not be described in detail.

Figure 9:
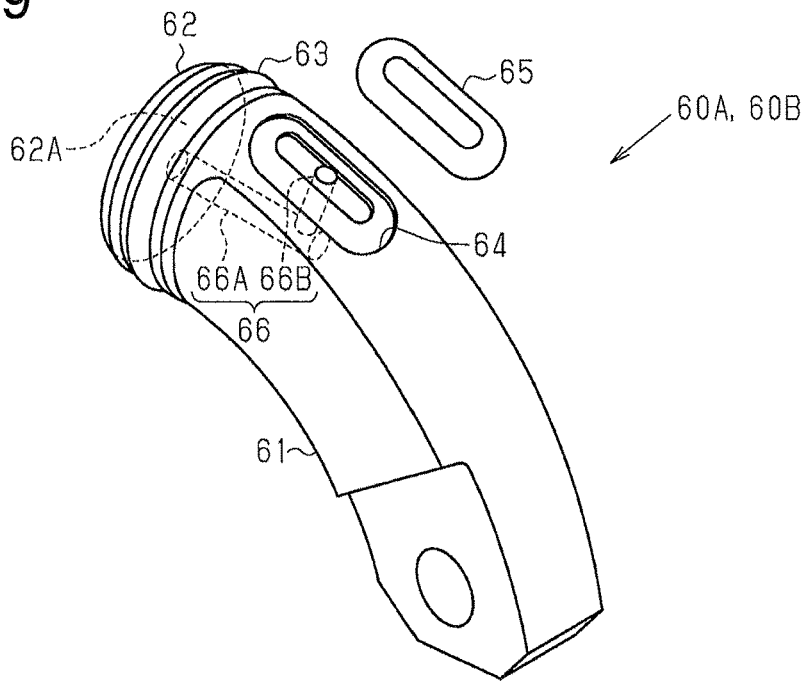
FIG. 9 is an exploded perspective view showing a piston of a third embodiment of a rotary actuator.

As shown in FIG. 9, the piston body 61 of each of the pistons 60A, 60B includes a peripheral portion, which is adjacent to the seal portion 62 in the circumferential direction. Each peripheral portion includes an annular groove 64, in which the major axis extends in the circumferential direction and the minor axis extends in the axial direction. A packing 65 is attached to each annular groove 64. One example of the packing 65 is an O-ring.

The pistons 60A, 60B each include an oil inlet 66, which is one example of a stopper and a fluid passage that communicates the end surface 62A of the seal portion 62 and a portion in the peripheral surface of the piston body 61 surrounded by the annular groove 64. Each oil inlet 66 includes a first oil passage 66A, which extends straight in a direction orthogonal to the end surface 62A, and a second oil passage 66B, which radially extends from the first oil passage 66A. The first oil passage 66A has a larger cross-sectional area than the second oil passage 66B.

Figure 10:
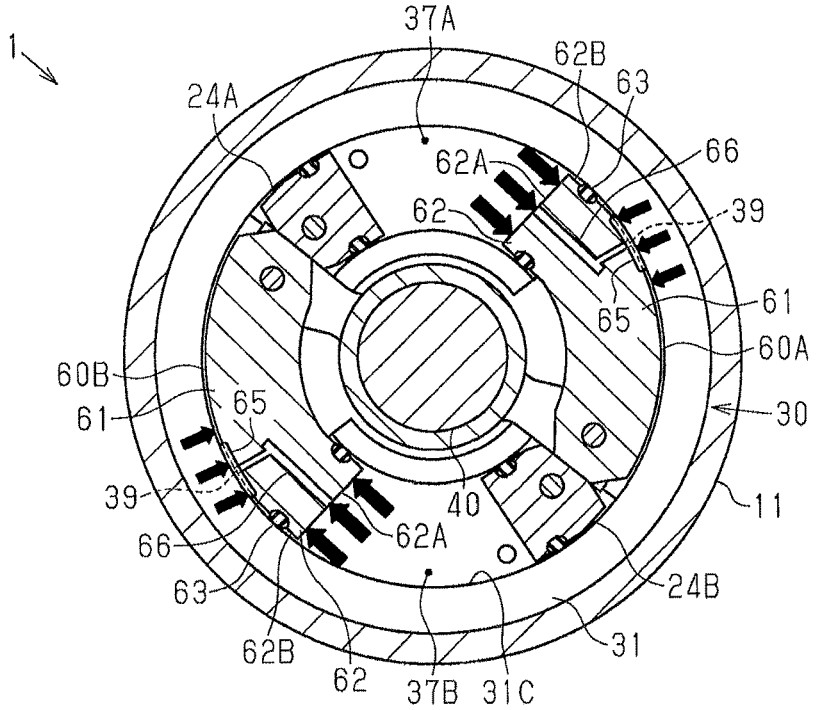
FIG. 10 is a cross-sectional view showing the internal structure of the rotary actuator.

As shown in FIG. 10, an outer hydraulic chamber 39 is formed between a portion of each piston body 61 that is surrounded by the packing 65 and a portion of the inner circumferential surface 31C of the outer wall 31 of the cylinder block 30 that is opposed to the portion of each piston body 61. Each outer hydraulic chamber 39 is one example of an outer fluid bearing chamber and a stopper. The outer hydraulic chambers 39 are respectively in communication with the first hydraulic chambers 37A, 37B through the oil inlets 66. Thus, the hydraulic pressure of the first hydraulic chambers 37A, 37B is transmitted to the outer hydraulic chambers 39.

Each outer hydraulic chamber 39 may be formed in a portion of the piston body 61 that is farther from the seal portion 62 than the outer hydraulic chamber 39 of the third embodiment. Additionally, the oil inlets, which communicate the first hydraulic chambers 37A, 37B and the outer hydraulic chambers 39, may be formed in the outer wall 31 of the cylinder block 30 instead of the pistons 60A, 60B. In this case, the outer hydraulic chambers 39 are formed in the outer wall 31 so that the oil inlets and the outer hydraulic chambers 39 remain in communication even when the pistons 60A, 60B orbit.

The third embodiment has the effects and advantages described below.

(1) The outer hydraulic chambers 39, which are in communication with the first hydraulic chambers 37A, 37B through the oil inlets 66, are formed between the pistons 60A, 60B and the inner circumferential surface 31C of the outer wall 31 of the cylinder block 30. Thus, the hydraulic pressure of the first hydraulic chambers 37A, 37B is applied to the outer hydraulic chambers 39. Consequently, as shown in FIG. 10, the hydraulic pressure of the outer hydraulic chambers 39 pushes the piston bodies 61 of the pistons 60A, 60B inward in the radial direction. This decreases the force pressing the circumferential surfaces 62B of the seal portions against the inner circumferential surface 31C of the outer wall 31 when the pressure of first hydraulic chambers 37A, 37B pushes the end surfaces 62A of the seal portions 62 of the pistons 60A, 60B. Consequently, the smooth movement of the pistons 60A, 60B improves the output efficiency of the rotary actuator 1.

(2) The packings 65, which are attached to the annular grooves 64 of the piston bodies 61, form the outer hydraulic chambers 39. Thus, when the pistons 60A, 60B move, the outer hydraulic chambers 39 move integrally with the pistons 60A, 60B. This allows the outer hydraulic chambers 39 to be formed regardless of the movement range of the pistons 60A, 60B.

(3) Each outer hydraulic chamber 39 is formed in a portion of the piston body 61 that is adjacent to the seal portion 62. Thus, the outer hydraulic chamber 39 acts to further directly support the circumferential surface 62B of the seal portion 62 that is pressed against the inner circumferential surface 31C of the outer wall 31. This further decreases the force pressing the circumferential surface 62B of the seal portion 62 against the inner circumferential surface 31C of the outer wall 31.

Figure 11:
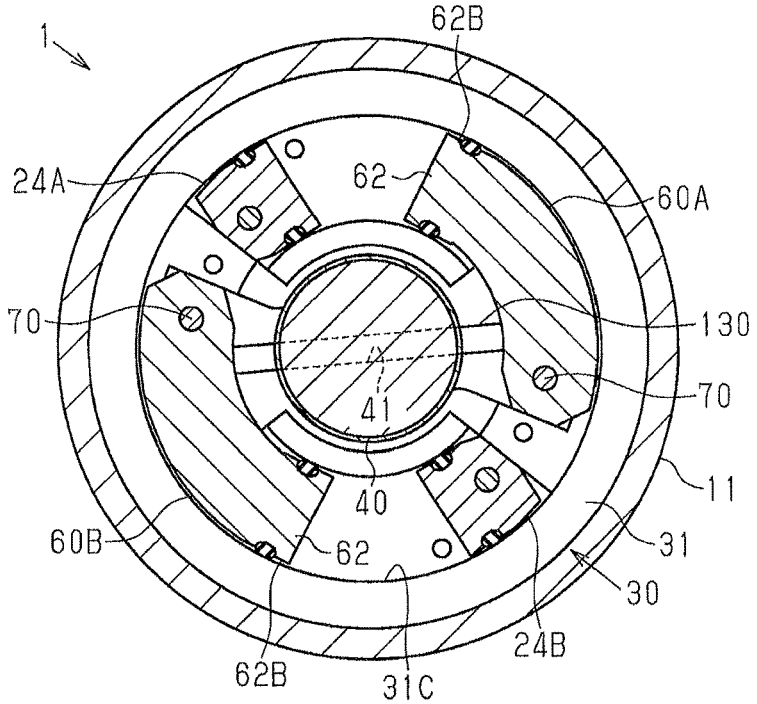
FIG. 11 is a cross-sectional view showing the internal structure of a fourth embodiment of a rotary actuator.

The structure of a fourth embodiment of the rotary actuator 1 will now be described with reference to FIG. 11. The same reference characters are given to elements of the rotary actuator 1 of the fourth embodiment that are the same as the corresponding elements of the rotary actuator 1 of the first embodiment. Such elements will not be described in detail.

A through hole 41 extends through the output shaft 40 in the radial direction. The through hole 41 receives a coupling rod 130, which is one example of a stopper included in the friction reducer. The coupling rod 130 projects out of the output shaft 40 in the radial direction and is coupled to an inner side surface of each of the pistons 60A, 60B. More specifically, the coupling rod 130 couples the pistons 60A, 60B to each other. The coupling rod 130 intersects with the axis of the output shaft 40. The coupling rod 130 is coupled to a portion of each of the pistons 60A, 60B separated from the bolt 70 in the circumferential direction so that the coupling rod 130 cannot be rotated relative to the pistons 60A, 60B. In the fourth embodiment, a plurality of pistons such as the pistons 60A, 60B are necessary.

The coupling rod 130 may be rotationally coupled to the pistons 60A, 60B. In this case, the coupling rod 130 is rotationally coupled to projections (not shown), which project from the piston bodies 61 of the piston 60A, 60B in the axial direction.

The fourth embodiment has the effects and advantages described below.

(1) The pistons 60A, 60B receive force that moves the pistons 60A, 60B outward in the radial direction. The coupling rod 130, which couples the pistons 60A, 60B in the radial direction, limits increases in the radial distance between the pistons 60A, 60B. Additionally, the pistons 60A, 60B receive force that moves the pistons 60A, 60B in radially opposite directions. However, the length of the coupling rod 130 does not change. Thus, the force moving the piston 60A outward in the radial direction offsets the force moving the piston 60B outward in the radial direction. This decreases the force pressing the circumferential surfaces 62B of the seal portions 62 of the pistons 60A, 60B against the inner circumferential surface 31C of the outer wall 31 and reduces the friction between the seal portions 62 and the outer wall 31. Consequently, the smooth movement of the pistons 60A, 60B improves the output efficiency of the rotary actuator 1.

(2) The coupling rod 130 couples the pistons 60A, 60B to each other. Thus, the coupling rod 130 functions as a stopper shared by the pistons 60A, 60B. This reduces the number of components of the rotary actuator 1 compared to a structure in which each of the pistons 60A, 60B include a stopper.

Figure 12:
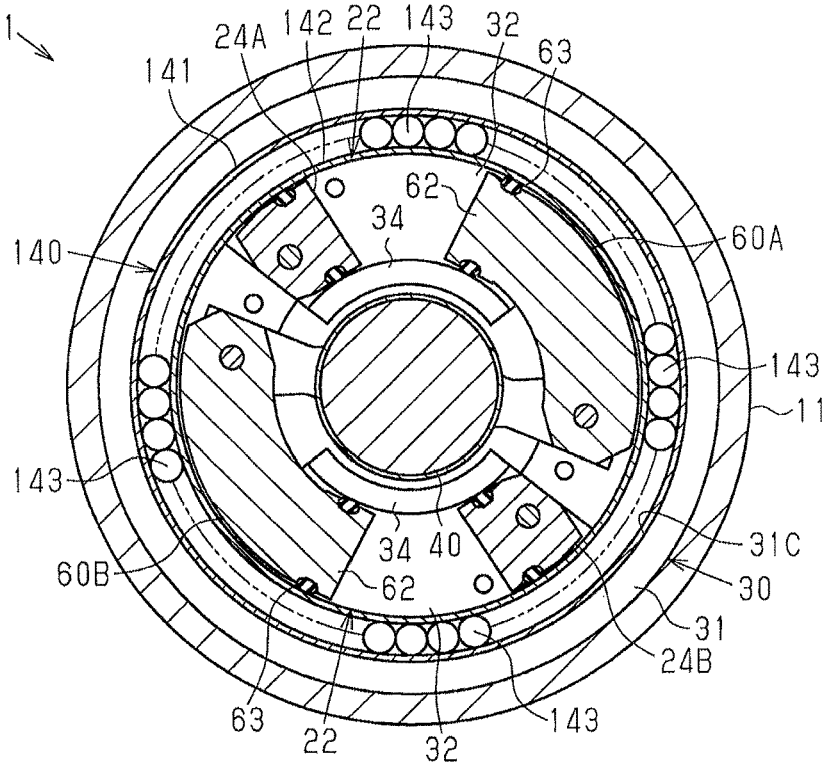
FIG. 12 is a cross-sectional view showing the internal structure of a fifth embodiment of the rotary actuator.

The structure of a fifth embodiment of the rotary actuator 1 will now be described with reference to FIG. 12. The same reference characters are given to elements of the rotary actuator 1 of the fifth embodiment that are the same as the corresponding elements of the rotary actuator 1 of the first embodiment. Such elements will not be described in detail.

A rolling bearing 140 is coupled to the inner circumferential surface 31C of the outer wall 31 of the cylinder block 30. The rolling bearing 140 includes an outer race 141, which is coupled to the inner circumferential surface 31C of the outer wall 31, an inner race 142, which is separated from the outer race 141 inward in the radial direction and is one example of a rotational race, and a plurality of bearing rollers 143, which is located between the outer race 141 and the inner race 142. The packings 63 of the seal portions 62 of the pistons 60A, 60B are in contact with an inner circumferential surface of the inner race 142. One example of the bearing roller 143 is a ball.

In the first embodiment, the arcuate bore 22 is a cavity surrounded by the inner walls 34, portions of the outer wall 31 opposed to the inner walls 34, and the bottom walls 32. Instead, the arcuate bore 22 is a cavity surrounded by portions of the inner race 142 opposed to the inner walls 34, the inner walls 34, and the bottom walls 32.

Here, the bearing roller 143 may be a roller other than a ball such as a tubular roller or a needle roller. Additionally, the outer race 141 may be omitted from the rolling bearing 140. In this case, the outer wall 31 is configured to be an outer race.

The fifth embodiment has the effects and advantages described below.

The rotary actuator 1 includes the rolling bearing 140, which is in contact with the pistons 60A, 60B. Thus, when the pistons 60A, 60B orbit, the inner race 142 of the rolling bearing 140, which is in contact with the seal portions 62, rotates integrally with the pistons 60A, 60B. Consequently, the smooth orbit of the pistons 60A, 60B improves the output efficiency of the rotary actuator 1.

It should be apparent to those skilled in the art that the present invention may be embodied in many other specific forms without departing from the scope of the invention. Particularly, it should be understood that the present invention may be embodied in the following forms.

First Modified Example

Figure 13:
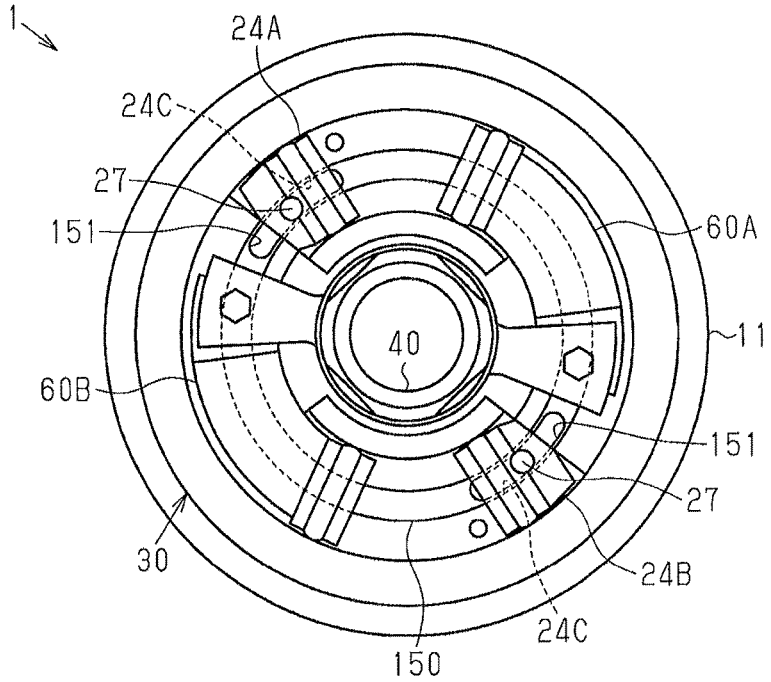
FIG. 13 is a plan view showing the internal structure of a rotary actuator of a first modified example.
Figure 14:
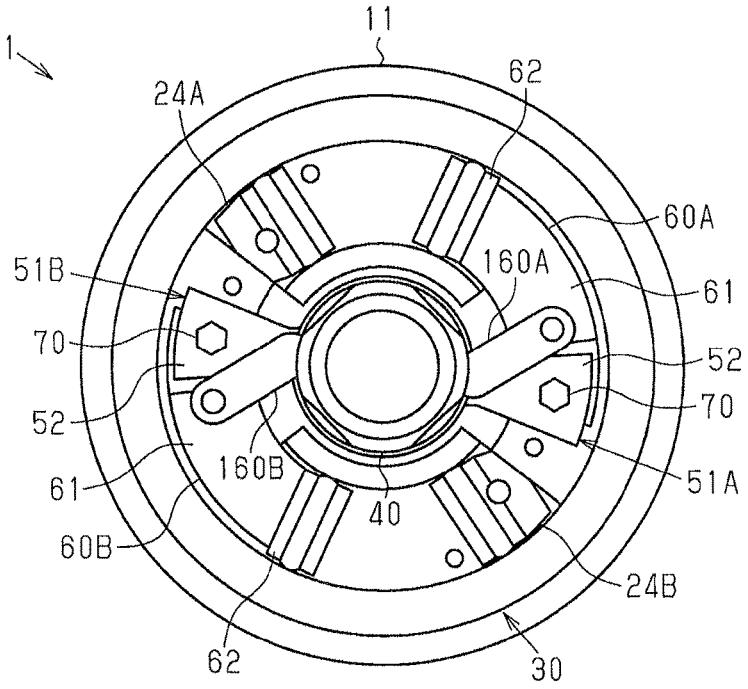
FIG. 14 is a plan view showing the internal structure of another rotary actuator of the first modified example.

The stopper, which reduces the force pressing the circumferential surfaces 62B, 115A of the seal portions 62, 115 of the pistons 60A, 60B, 110A, 110B against the inner circumferential surface 31C of the outer wall 31, may have a structure shown in FIG. 13 or 14 instead of the structures of the second to fourth embodiments.

As shown in FIG. 13, the rotary actuator 1 includes a ring 150, which couples the pistons 60A, 60B in the circumferential direction and functions as a stopper. The ring 150, which is coaxial with the axis of the output shaft 40, rotates integrally with the pistons 60A, 60B. Each of the partition pistons 24A, 24B includes an insertion hole 24C, into which the ring 150 is inserted. The ring 150 includes elongated arcuate holes 151, which receive the pins 27 of the partition pistons 24A, 24B so that the ring 150 is movable relative to the pins 27. The ring 150 is movable relative to the partition pistons 24A, 24B in the circumferential direction. This structure obtains advantages (1) and (2) of the fourth embodiment.

As shown in FIG. 14, the rotary actuator 1 includes a coupling rod 160A, which couples the output shaft 40 and the piston 60A and functions as a stopper, and a coupling rod 160B, which couples the output shaft 40 and the piston 60B and functions as a stopper. The coupling rods 160A, 160B are coupled to portions of the corresponding pistons 60A, 60B located closer to the seal portion than where the pistons 60A, 60B are fastened to the arm pairs 51A, 51B by the bolts 70 and the nuts 71 (refer to FIG. 3).

Second Modified Example

Figure 15:
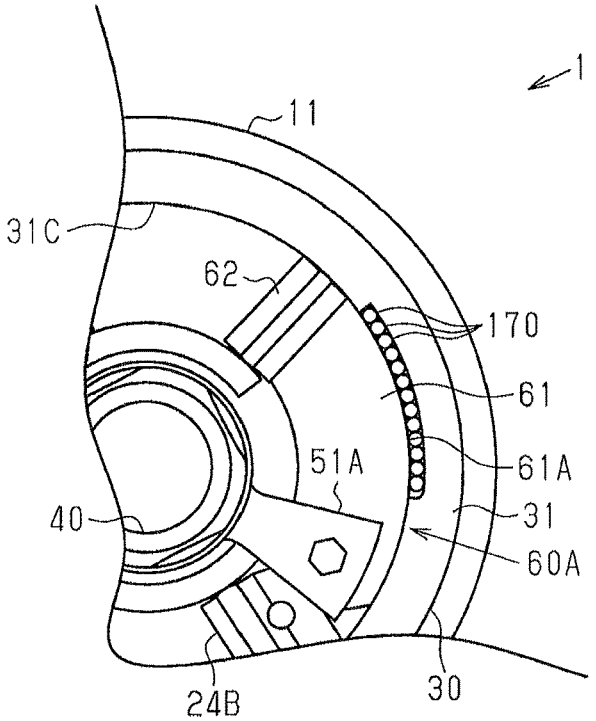
FIG. 15 is a plan view showing the internal structure of a rotary actuator of a second modified example.
Figure 16:
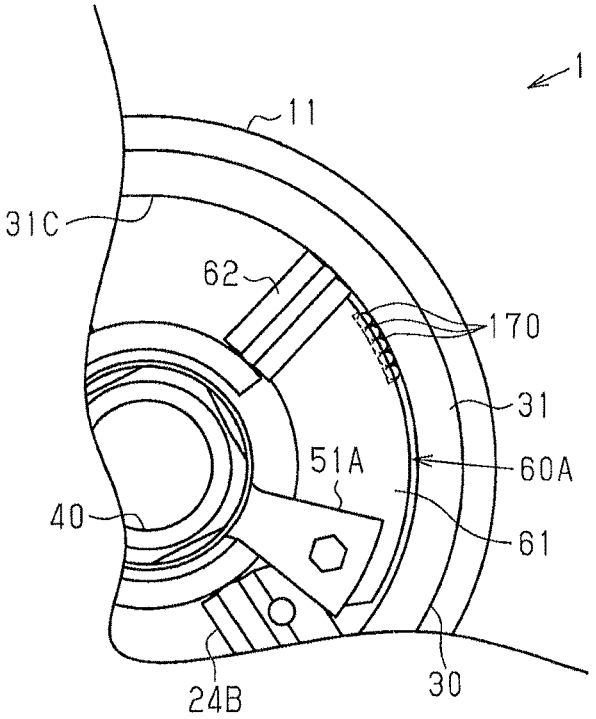
FIG. 16 is a plan view showing the internal structure of another rotary actuator of the second modified example.

Instead of the roller 81 of the first embodiment, the friction reducer may include balls 170, which are located between the pistons 60A, 60B and the outer wall 31 as shown in FIGS. 15 and 16.

FIG. 15 shows a friction reducer in which the balls 170 are rotationally embedded in the outer wall 31 of the cylinder block 30 and partially located at an inner side of the inner circumferential surface 31C of the outer wall 31. The arcuate outer side surface 61A of the piston body 61 of the piston 60A is in contact with the balls 170. Although not shown in FIG. 15, the arcuate outer side surface 61A of the piston body 61 of the piston 60B is also in contact with the balls 170.

FIG. 16 shows a friction reducer in which the balls 170 are rotationally embedded in the peripheral portion of the piston body 61 of the piston 60A and partially located at an outer side of the peripheral surface of the piston body 61. The inner circumferential surface 31C of the outer wall 31 is in contact with the balls 170. Although not shown in FIG. 16, the balls 170 are embedded in the piston body 61 of the piston 60B.

Third Modified Example

Figure 17:
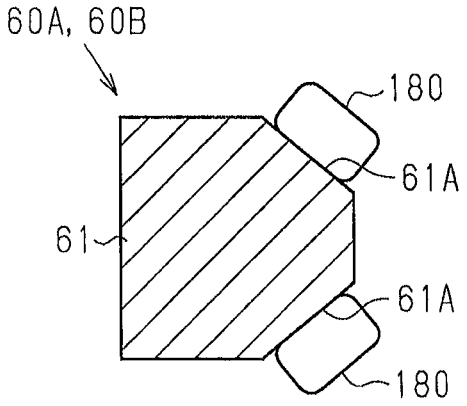
FIG. 17 is a cross-sectional view showing a piston and rollers of a third modified example.
Figure 18:
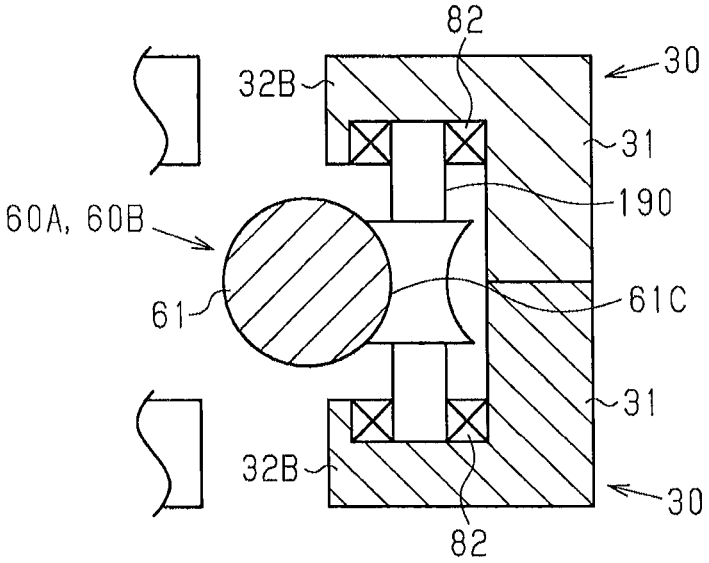
FIG. 18 is a cross-sectional view showing another piston another roller, and a cylinder block of the third modified example.

The structure of the rollers 81, which support the pistons 60A, 60B of the first embodiment, may be changed to those shown in FIGS. 17 and 18.

As shown in FIG. 17, the piston body 61 of each of the pistons 60A, 60B includes two arcuate outer surfaces 61A, which are separated in the axial direction and inclined to form a tapered surface. A rotatable rod-shaped roller 180 is in linear contact with each arcuate outer side surface 61A. A plurality of rotatable rollers 180 may be in linear contact with each arcuate outer side surface 61A.

As shown in FIG. 18, the peripheral surface of the piston body 61 of each of the pistons 60A, 60B defines a roundly curved surface 61C. A rotatable roller 190, which is a concave portion and extends in the axial direction, is in linear contact with the curved surface 61C. The rolling bearings 82 rotationally support two opposite ends of the roller 190 on the cylinder block 30.

Fourth Modified Example

In the first embodiment, the rollers 81 are located at radially outer sides of the pistons 60A, 60B. Instead, the rollers 81 may be located in radially middle portions of the pistons 60A, 60B. More specifically, arcuate through holes extend through the radially middle portions of the pistons 60A, 60B in the axial direction. The rollers 81 are inserted into the through holes. When the pistons 60A, 60B orbit, the rollers 81 roll relative to the pistons 60A, 60B in contact with the walls of the through holes. This obtains advantage (1) of the first embodiment.

Fifth Modified Example

The arcuate outer side surface 61A may be omitted from the piston body 61 of each of the pistons 60A, 60B of the first embodiment. In this case, the piston body 61 is formed in the same manner as the seal portion 62. Additionally, the roller 81 is in point contact with the piston body 61. Further, when the arcuate outer side surface 61A is omitted from the piston body 61, the piston body 61 may be formed so that the peripheral surface of the piston body 61 contacts the inner circumferential surface 31C of the outer wall 31.

Sixth Modified Example

In the second embodiment, the coupling structure of the pistons 110A, 110B and the arms 101A, 101B is not limited to such a structure in which the first bolt 121 and the second bolt 122 are respectively fastened to the first fastening hole 113 and the second fastening hole 114.

In one example, at least one of the first fastening hole 113 and the second fastening hole 114 may be changed to an insertion hole, which is capable of receiving the corresponding one of the first bolt 121 and the second bolt 122. In this structure, when the insertion hole receives the corresponding one of the first bolt 121 and the second bolt 122, a nut may be coupled to the inserted bolt. In this case, the insertion hole and the inserted bolt form no gap or a slight gap. Thus, the insertion hole and the inserted bolt function as a stopper, which decreases the force pressing the circumferential surfaces 62B of the seal portions 62 against the inner circumferential surface 31C of the outer wall 31 of the cylinder block 30.

In another example, one of the first bolt 121 and the second bolt 122 may be omitted. In this case, the pistons 110A, 110B each include a projection, and the arms 101A, 101B each include a recess. Alternatively, the pistons 110A, 110B can each include a recess, and the arms 101A, 101B can each include a projection. In this case, the projection and recess function as a stopper and a coupling portion of each of the pistons 110A, 110B and the arms 101A, 101B.

In another example, when the arms 101A, 101B are configured to be axially extended and circumferentially opposed to the pistons 110A, 110B, and the cutaway portions 112 are omitted from the pistons 110A, 110B, the arms 101A, 101B and the pistons 110A, 110B may be configured to be fixed in the circumferential direction. In one example of the structure for fixing the arms 101A, 101B and the pistons 110A, 110B in the circumferential direction, the arms 101A, 101B each include a circumferential end projection, and the pistons 110A, 110B each include a circumferential end press-fitting hole, to which the projection is press-fitted. Alternatively, the pistons 110A, 110E can each include a circumferential end projection, and the arms 101A, 101B can each include a circumferential end press-fitting hole, to which the projection is press-fitted.

Seventh Modified Example

Figure 19:
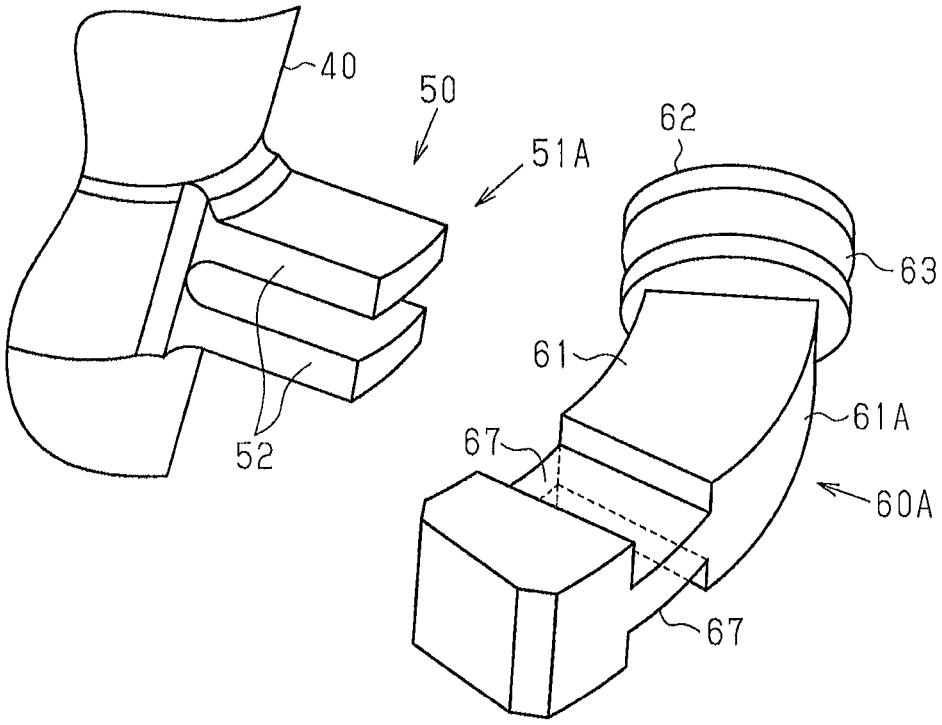
FIG. 19 is an exploded perspective view showing an arm pair and a piston of a seventh modified example.

In the first and third to fifth embodiments, the rotary actuator 1 has a structure in which the pistons 60A, 60B are fastened to the arm pairs 51A, 51B by the bolts 70 and the nuts 71 when located between the two arms 52 of the arm pairs 51A, 51B. The coupling structure of the arm pairs 51A, 51B and the pistons 60A, 60B is not limited to such a structure. For example, instead of the bolts 70 and the nuts 71, as shown in FIG. 19, engagement recesses 67 are formed in axially opposite sides of the piston body 61 of the piston 60A. The engagement recesses 67 are engaged with the arms 52 of the arm pair 51A. This structure restricts the radially outward rotation of the piston 60A relative to the arm pair 51A. Also, the engagement recesses 67 may be formed in the piston 60B. In this case, the coupling structure of the piston 60B and the arm pair 51B is the same as that of the piston 60A and the arm pair 51A. The pistons 110A, 110B of the second embodiment may be changed in the same manner.

Eighth Modified Example

In the rotary actuator 1 of the third and fourth embodiments, when the hydraulic pressure of the first hydraulic chambers 37A, 37B pushes the pistons 60A, 60B, the piston bodies 61, 111 of the pistons 60A, 60B, 110A, 110B contact the inner circumferential surface 31C of the outer wall 31. Instead, in the same manner as the first embodiment, the rotary actuator 1 of the third and fourth embodiments may include the gap G between the piston bodies 61, 111 and the inner circumferential surface 31C of the outer wall 31 so that the piston bodies 61, 111 of the pistons 60A, 60B, 110A, 110B do not contact the inner circumferential surface 31C of the outer wall 31.

The above description is intended to be illustrative, and not restrictive. For example, the above-described examples (or one or more aspects thereof) may be used in combination with each other. Other embodiments can be used, such as by one of ordinary skill in the art upon reviewing the above description. Also, in the above detailed description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the detailed description, with each claim standing on its own as a separate embodiment. The scope of the invention should be determined with reference to the appended claims, along with the full scope of equivalents to which such claims are entitled.

The invention claimed is:

1. A rotary actuator comprising:

an output shaft;

a housing including at least one arcuate bore that extends around the output shaft;

a first piston and a second piston coupled to the output shaft and configured to be moved in the at least one arcuate bore, wherein the first and second pistons are located at opposite sides of the output shaft, wherein fluid pressure is configured to move the first and second pistons in the at least one arcuate bore; and a friction reducer configured to reduce friction between each of the first and second pistons and an inner circumferential surface of the housing, wherein each of the first and second pistons includes a head and a non-head portion, wherein the output shaft includes a first arm and a second arm coupled to the corresponding first and second pistons, wherein the first and second pistons and the corresponding first and second arms are coupled in an axial direction of the output shaft, and wherein the friction reducer further comprises a coupler rod that is configured to couple the first piston and the second piston in a radial direction to reduce the force that causes the first and second pistons to press against the inner circumferential surface of the housing.

2. A rotary actuator comprising:

an output shaft;

a housing including an arcuate bore that extends around the output shaft;

a piston coupled to the output shaft and moved in the arcuate bore, wherein pressure fluid acts to move the piston; and a rolling bearing that includes a rotational race and a bearing roller, wherein the rotational race forms the arcuate bore, the rotational race is in contact with the peripheral surface of the piston, and the bearing roller is located between the inner circumferential surface of the housing and the rotational race.

3. The rotary actuator according to claim 2, wherein the piston includes an outer side surface, and at least a portion of the outer side surface of the piston and the inner circumferential surface of the housing are spaced apart by a gap.

4. A rotary actuator comprising:

an output shaft;

a housing including at least one arcuate bore that extends around the output shaft;

a first piston and a second piston coupled to the output shaft and configured to be moved in the at least one arcuate bore, wherein the first and second pistons are located at opposite sides of the output shaft, wherein fluid pressure is configured to move the first and second pistons in the at least one arcuate bore; and a friction reducer configured to reduce friction between each of the first and second pistons and an inner circumferential surface of the housing, wherein each of the first and second pistons includes a head and a non-head portion, and wherein the friction reducer comprises a ring configured to couple the first piston and the second piston so as to reduce a force that causes the first and second pistons to press against the inner circumferential surface of the housing.

* * * * *